United States Patent [19]

Gotchy

[11] 3,932,300

[45] Jan. 13, 1976

[54] SYSTEM FOR DISPOSING OF RADIOACTIVE WATER

[75] Inventor: Reginald L. Gotchy, Bethesda, Md.

[73] Assignee: The United States of America as represented by the United States Energy Research and Development Administration, Washington, D.C.

[22] Filed: Sept. 10, 1973

[21] Appl. No.: 395,677

[52] U.S. Cl... 252/301.1 W; 166/247; 252/301.1 R; 423/210; 423/248

[51] Int. Cl.[2] ..... G21F 9/02

[58] Field of Search..... 252/301.1 W; 166/247; 423/248, 210

[56] References Cited

UNITED STATES PATENTS

| | | | |
|---|---|---|---|
| 3,608,636 | 9/1971 | Dixon | 166/247 |
| 3,706,630 | 12/1972 | Cohen et al. | 252/301.1 W |

OTHER PUBLICATIONS

Nuclear Science Abstracts, Vol. 24, No. 7542.

*Primary Examiner*—Leland A. Sebastian
*Assistant Examiner*—Deborah L. Kyle
*Attorney, Agent, or Firm*—John A. Horan; John A. Koch

[57] ABSTRACT

A system for reducing radioactivity released to the biosphere in the course of producing natural gas from a reservoir stimulated by the detonation of nuclear explosives therein. Tritiated water produced with the gas is separated out and returned to a nuclear chimney through a string of tubing positioned within the well casing. The tubing string is positioned within the well casing in a manner which enhances separation of the water out of the gas and minimizes entrainment of water into the gas flowing out of the chimney.

6 Claims, 1 Drawing Figure

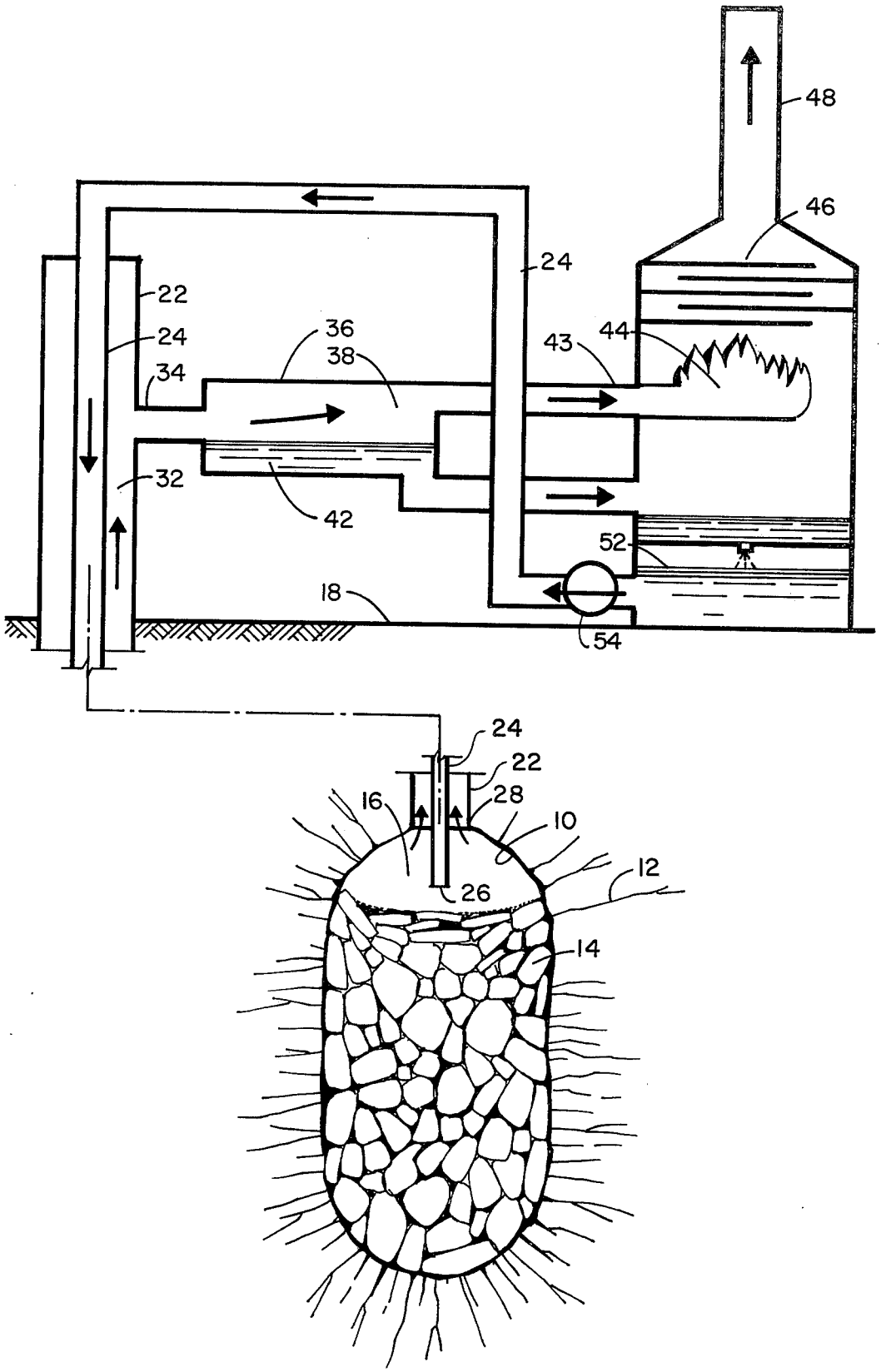
48
46
24
22
24
36
38
34
43
44
32
42
52
18
54
24
22
28
16
10
12
26
14

SYSTEM FOR DISPOSING OF RADIOACTIVE WATER

The invention described herein was made in the course of or under employment with the U.S. Atomic Energy Commission.

BACKGROUND OF THE INVENTION

This invention relates to the use of nuclear explosives in the production of natural gas from subterranean formations. More particularly, this invention relates to a system for reducing the amount of radio-activity released to the biosphere in the course of producing natural gas from a reservoir stimulated by the detonation of one or more nuclear explosives in gas bearing strata.

The growing shortage of natural gas reservoirs from which gaseous hydrocarbons can be produced by conventional means has led to a growing interest in the possibility of recovering natural gas from so-called tight or impermeable formations after fracturing the formations by detonating nuclear explosives therein. Two natural gas stimulation projects, i.e., Project Gasbuggy and Project Rulison, have demonstrated the technical feasibility of using nuclear explosive to stimulate the production of natural gas from such formations. However, concern has been expressed by some regarding the radioactivity that is produced in natural gas reservoirs by the detonation of nuclear explosives therein and the release of that radioactivity to the biosphere in connection with the production of the gas therefrom.

The testing programs utilized in connection with projects Gasbuggy and Rulison each included the flaring (burning) of large quantities of gas. It can be anticipated that future nuclear gas stimulation projects, whether developmental or production, will also involve the flaring of fairly large quantities of gas. Of course flaring gas from a new reservoir in order to calibrate the flow prior to placing the output on a distribution line is a common practice. In the case of a nuclearly stimulated reservoir, however, the first gas produced therefrom comes from the nuclear chimney and may contain as much as 40% $CO_2$. Also, the radioactivity of the gas - due primarily to tritium ($^3H$) and $^{85}$krypton — is highest in the first gas produced but decreases at an accelerating rate.

Accordingly, the most effective approach to the development of a particular nuclearly stimulated natural gas reservoir to the point where the gas produced therefrom is of sufficiently high BTU content and sufficiently low radioactivity to be commercially acceptable may be to flare some volume of gas representing some fraction of each chimney volume. The fraction of a chimney volume flared would vary from gas field to gas field depending, among other things, upon the quantity, BTU content and radioactivity of the gas with which the gas from the nuclear stimulated reservoir would be diluted prior to delivery to the consummer.

As indicated in Report No. PNE-R-57, "Project Rulison, Final Operational Report, Production Tests," available from the National Information Service, U.S. Department of Commerce, the total radioactivity estimated to have been released to the environment during the Project Rulison production tests through flaring a total of 455 $M^2CF$ (million standard cubic feet) of gas was 2824 curies of $^3H$, 1,064 curies of $^{85}Kr$, 2.4 curies of $^{14}C$, 0.00011 curies of $^{203}Hg$ and a few curies of $^{37,39}Ar$ and naturally occurring $^{222}Rn$. The radioactivity concentrations in the gas ranged from 185 pCi/cc of $^3H$, 145 pCi/cc of $^{85}Kr$ and 0.35 pCi/cc of $^{14}C$ after a calibration flaring of a total of 12.5 $M^2CF$ to about 3.3 pCi/cc of $^3H$, 2.8 pCi/cc of $^{85}Kr$ and 0.07 pCi/cc of $^{14}C$ at the end of the flaring of a total of 455 $M^2CF$.

The dispersal of the radioactivity effected by the Rulison flare stack resulted in an actual population dose of a very low level. The Environmental Protection Agency estimates that the population dose resulting from the Project Rulison flaring of the 455 $M^2CF$ alluded to above was on the order of about 0.001 mrem. However, there is an incentive, particularly from a public relations standpoint, to reduce the contribution to the population dose attributable to nuclear stimulation projects to as low a value as practicable.

SUMMARY OF THE INVENTION

Accordingly, it is object of the invention to reduce the amount of radioactivity released to the biosphere by projects involving stimulation of natural gas recovery by use of nuclear explosives. It is a further object of this invention to reduce the amount of tritium released to the biosphere through the production of gases from a nuclearly stimulated natural gas reservoir. It is an additional object to reduce the amount of tritium released through flaring gas produced from a nuclearly stimulated gas reservoir.

Briefly summarized, the above and additional objects and advantages are accomplished by separating liquid water and water vapor from the gaseous mixture produced from a nuclear chimney and pumping this water, which will contain most of the tritium, back into a chimney through a string of tubing positioned within the well casing that connects the chimney with ground surface. Water formed upon combustion of the gas during flaring operations is condensed out of the combustion products and pumped into the chimney along with the separated water.

Pumping the water down a string of tubing which is positioned within the well casing while the chimney gases flow upwardly in counter current relationship within the annulus between the tubing and the well casing removes heat from the gases thereby enhancing the effectiveness of the separation of the water from the gas. That arrangement also permits the end of the tubing to be positioned some distance below the opening of the well casing at the top of the chimney formation in order to minimize the entrainment of the reinjected water into the upwardly flowing, high velocity gases entering the annulus in the well casing. Additional objects and advantages and a better understanding of the invention will be apparent from consideration of the following description of a preferred embodiment thereof.

BRIEF DESCRIPTION OF THE DRAWING

The single FIGURE of drawing is an elevational schematic of apparatus as emplaced for practicing the invention in a preferred embodiment thereof, primarily in cross-section.

DESCRIPTION OF PREFERRED EMBODIMENT

As shown in the single FIGURE of drawing, a nuclear chimney 10 with associated radiating fractures 12 has been created in a gas bearing formation by detonation of one or more nuclear explosives. The chimney has the usual rubble zone 14 and void 16 at its top.

When the predetermined period of time has passed after the detonation of the nuclear explosive to permit the desired degree of decay of shortlived radioisotopes resulting from the nuclear explosion, communication with the chimney is gained by drilling out the stemming materials from well casing 22, which would normally have been a string of tubing utilized in connection with the emplacement of the nuclear explosives. Tubing string 24 is positioned within casing 22, its lower end 26 being lower in the chimney than lower end 28 of the well-bore casing for a reason that will be explained hereinafter. The remaining apparatus illustrated in the drawing will now be described in conjunction with the flow of fluids out from and into chimney 10.

The composition of the gases in chimney 10 at the time of the first withdrawal therefrom will include relatively large percentages of $CO_2$ and methane, some hydrogen gas and hydro-carbons of higher molecular weight than methane, and minor amounts of noble gases. This composition of chimney gas along with large quantities of water vapor and entrained liquid water is transported to the earth's surface through annulus 32 between tubing string 24 and well casing 22. The tritium isotope of hydrogen will be present in the hydrogen compounds in the chimney including hydrogen gas, the hydrocarbons and the water. Most of the tritium produced from the well, however, will be in the water which is produced along with the gas either as water vapor or entrained water. At the earth's surface the gas and water mixture flows through conduit 34 to liquid/gas separator 36 wherein the flow is separated into a gaseous fraction 38 and a liquid fraction 42 which would be primarily water. Gaseous fraction 38 flows through conduit 43 to burner 44 where it is mixed with oxygen and the hydrogen and hydrocarbons burned.

The combustion products and the other gases which were included in gaseous fraction 38, including $CO_2$, proceed upwardly through water condenser 46 to flare stack 48. Water formed as a combustion product is separated out by condenser 46 while the remaining combustion products and other gases (and heat of combustion) rise to the top of flare stack 48 from which they are dispersed into the atmosphere. The water from condenser 46 along with liquid fraction 42 from separator 36 are collected in water storage compartment 52. The contents of compartment 52 are pumped into chimney 10 by pump 54 through inner string 24 positioned within well-bore casing 22.

It will be appreciated by those familiar with the art that pumping water downwardly through inner tubing 24 reverses the normal practice in that the reservoir gas is generally produced through the inner string.

However, utilizing the inner string for the return of water to the chimney permits the water to be returned into the chimney at a level lower than open end 28 of well casing 22 thereby reducing the entrainment of returned water in the upwardly flowing, high velocity gas from the chimney.

It will also be appreciated that return of water down string 24 provides some cooling to the upwardly flowing gas mixture in annulus 32. This pre-cooling of the stream assists in the removal of water from the gaseous mixture produced from the chimney at liquid/gas separator 36.

Since, as indicated earlier, most of the total tritium in the chimney will be combined in the water, there may be projects where the quantities of tritium in the hydrogen gas and hydrocarbons are sufficiently low as to permit the water formed by the combustion of these gases at burner 44 to be released to the atmosphere through flare stack 48. Or, since the tritium content of the hydrogen and hydrocarbons will be highest at the start of flaring and will decrease at an accelerating rate, the return of the water of combustion of those gases to chimney 10 could be discountinued when the tritium content has decreased to a sufficiently low level that release of the water of combustion through the flare stack would not raise the radioactivity of the flare stack effluent above some selected standard.

In addition, when a natural gas field is to be developed by production of a plurality of horizontally spaced apart nuclear chimneys, it may be advantageous to return the tritiated water produced from one chimney to another chimney. The amount of water produced in conjunction with the production of gas from a reservoir is greatly affected by the temperature of the reservoir. As graphically illustrated in FIG. 2.1 of Report ORNL-TM-4024, entitled "Preliminary Evaluation of Methods for the Disposal of Tritiated Water from Nuclearly Stimulated Natural Gas Wells," by W. D. Arnold, et al (April 1973), available from National Technical Information Service, U.S. Department of Commerce, at a pressure of 1,000 psi, natural gas saturated with water will contain about 20,000 lbs. of water with each million standard feet at 400°F but less than about 4,000 lbs. at 300°F. It would be possible then, to decrease the total quantity of tritiated water produced from a field by returning water produced from a chimney at a higher temperature to another chimney in the field which is at a lower temperature. Since the temperature of a chimney will decrease with time and the production of gas therefrom, the water produced from newly created chimneys could be injected into one or more older chimneys in the field which have been under production some length of time and, therefore, largely depleted.

Also, in planning a natural gas nuclear stimulation project involving either a single chimney or a series of horizontally spaced apart chimneys, a nuclear explosive could be placed in one or more of the emplacement wells somewhat below what would be necessary for merely fracturing the gas bearing strata. This would provide a sump below the gas bearing strata into which water reinjected into the chimney would settle, thereby becoming somewhat immobilized with respect to being incorporated into the upward flowing stream of gas.

Accordingly, a great deal of flexibility is possible within the teachings of the invention in disposing of tritiated water in order to reduce the amount of radioactivity released to the biosphere. While the fundamental novel features of the invention has been shown and described and pointed out as applied to particular embodiments by way of explanation and example, it will be appreciated by those skilled in the art that various omissions, substitutions and changes may be made within the principle and scope of the invention as expressed in the appended claims.

What I claim is:

1. A method for reducing the amount of radioactivity released to the biosphere in connection with the production of gas from a nuclearly stimulated natural gas reservoir created in natural gas bearing strata comprising the steps of:

a. transporting the gaseous mixture including hydrocarbons, water vapor and entrained liquid water from a nuclearly created chimney in said reservoir to the earth's surface through an annulus formed between a pair of conduits, the first of which is positioned within the second, b. separating water from said gaseous mixture, and c. injecting the water separated from said gaseous mixture into a nuclearly created chimney through an inner of a pair of conduits, the first of which is positioned within the second, which inner conduit extends further into the chimney than the other of said pair whereby said injected water enters the chimney at a lower level than that from which the gaseous mixture of that chimney is received by the annulus between the pair of conduits for transportation to the earth's surface and said downwardly flowing water provides precooling to said upwardly flowing gaseous mixture.

2. The method of claim 1 wherein water of combustion formed upon burning combustible components of said gaseous mixture is injected into said chimney through said inner conduit.

3. The method of claim 1 including the step of creating a sump below the natural gas bearing strata in said chimney into which said water is injected.

4. The method of claim 1 wherein said gaseous mixture is obtained from a first chimney and said separated water is injected into a second chimney.

5. The method of claim 4 wherein said second chimney is at a lower temperature than said first chimney.

6. The method of claim 5 including the step of creating a sump in said second chimney below the natural gas bearing strata.

* * * * *